US007789231B2

(12) United States Patent
Requena

(10) Patent No.: US 7,789,231 B2
(45) Date of Patent: Sep. 7, 2010

(54) PACKAGE FOR CONTAINERS

(75) Inventor: Emili Requena, Igualada (ES)

(73) Assignee: Graphic Packaging International, Inc., Marietta, GA (US)

( * ) Notice: Subject to any disclaimer, the term of this patent is extended or adjusted under 35 U.S.C. 154(b) by 45 days.

(21) Appl. No.: 11/475,764

(22) Filed: Jun. 27, 2006

(65) Prior Publication Data

US 2007/0000794 A1 Jan. 4, 2007

(30) Foreign Application Priority Data

Jul. 4, 2005 (ES) ..... 200501662

(51) Int. Cl.
*B65D 75/00* (2006.01)

(52) U.S. Cl. ..... 206/427; 206/139

(58) Field of Classification Search ..... 206/427, 206/139, 140, 145, 147–149, 153–157, 160, 206/434; 294/87.2, 87.28
See application file for complete search history.

(56) References Cited

U.S. PATENT DOCUMENTS

| | | | | |
|---|---|---|---|---|
| 2,761,785 | A * | 9/1956 | Steger | 426/119 |
| 2,764,284 | A | 9/1956 | Arneson | |
| 2,950,041 | A * | 8/1960 | Stone | 206/147 |
| 3,327,845 | A * | 6/1967 | Hasselhoff | 206/430 |
| 3,401,865 | A * | 9/1968 | Holstrom | 229/159 |
| 3,692,228 | A * | 9/1972 | Spiegel | 206/486 |
| 3,767,041 | A | 10/1973 | Graser | |
| 4,188,766 | A | 2/1980 | Culpepper | |
| 4,192,540 | A | 3/1980 | Oliff | |
| 4,336,898 | A | 6/1982 | Joyce | |
| 4,432,579 | A * | 2/1984 | Denmark et al. | 294/87.2 |
| 4,438,843 | A | 3/1984 | Graser | |
| 4,566,591 | A | 1/1986 | Turtschan et al. | |
| 4,621,734 | A * | 11/1986 | Heijnen et al. | 206/427 |
| 4,749,086 | A * | 6/1988 | Donohie | 229/227 |
| 5,135,104 | A | 8/1992 | Jorba | |
| 5,188,225 | A | 2/1993 | Jorba | |
| 5,598,920 | A | 2/1997 | Hansen | |
| 5,687,838 | A | 11/1997 | Bakx | |
| 6,168,012 | B1 * | 1/2001 | Galbierz | 206/153 |
| 6,223,892 | B1 | 5/2001 | Bakx | |
| 6,488,322 | B2 | 12/2002 | Bakx | |
| 6,615,984 | B2 | 9/2003 | Saulas et al. | |
| 7,264,114 | B2 * | 9/2007 | Daniel | 206/152 |
| 2002/0113449 | A1 | 8/2002 | Bakx | |
| 2004/0079666 | A1 | 4/2004 | Bakx | |
| 2004/0226833 | A1 * | 11/2004 | Daniel | 206/139 |
| 2008/0135423 | A1 * | 6/2008 | Oliveira | 206/147 |

FOREIGN PATENT DOCUMENTS

| | | | |
|---|---|---|---|
| DE | 203 17 334 | U1 | 2/2004 |
| DE | 20 2004 017 954 | U1 | 2/2005 |
| EP | 46133 | A1 * | 2/1982 |

(Continued)

*Primary Examiner*—Ehud Gartenberg
*Assistant Examiner*—Ernesto A Grano
(74) *Attorney, Agent, or Firm*—Womble Carlyle Sandridge & Rice, PLLC

(57) ABSTRACT

A package is formed from a carton and containers extending through a bottom panel of the carton. The carton also includes a top panel, and an intermediate panel located between the top and bottom panels. The intermediate panel acts to stabilize the containers within the carton.

19 Claims, 5 Drawing Sheets

FOREIGN PATENT DOCUMENTS

| | | | |
|---|---|---|---|
| EP | 0 048 506 | | 3/1982 |
| EP | 0 285 043 | A1 | 10/1988 |
| EP | 0 398 835 | B1 | 11/1990 |
| EP | 0 495 197 | A1 | 7/1992 |
| EP | 0 541 334 | A1 | 5/1993 |
| EP | 1 070 671 | A1 | 1/2001 |
| EP | 1 384 679 | A1 | 1/2004 |
| FR | 1.582.235 | | 9/1969 |
| FR | 2 525 992 | | 11/1983 |
| FR | 2 664 239 | | 1/1992 |
| FR | 2 731 413 | | 9/1996 |
| GB | 1 342 180 | | 12/1973 |
| GB | 2 158 037 | A | 11/1985 |
| WO | WO 97/33807 | | 9/1997 |
| WO | WO 98/49071 | | 11/1998 |
| WO | WO 02/059011 | A2 | 8/2002 |
| WO | WO 02/062676 | A1 | 8/2002 |
| WO | WO 02/079048 | A1 | 10/2002 |
| WO | WO 2005/095222 | A1 | 10/2005 |

* cited by examiner

PACKAGE FOR CONTAINERS

CROSS-REFERENCE TO RELATED APPLICATION

This application claims priority under 35 U.S.C. §119(b) to Spanish application serial no. 200501662/4, filed on Jul. 4, 2005, the contents of which is hereby incorporated in its entirety as if repeated herein.

BACKGROUND

1. Technical Field

The technical field relates to cartons for accommodating containers and packages formed therefrom.

2. Related Art

Cartons for engaging upper portions of containers are known. The containers are typically inserted through apertures in a panel of the carton and secured by engaging a radially protruding part of the containers. One such carton is disclosed in U.S. Pat. No. 6,223,892 to Bakx. Cartons such as those disclosed by Bakx, however, may not sufficiently secure the containers within the carton.

SUMMARY

According to a first embodiment, a package comprises a top panel, a first side panel adjacent to the top panel, a bottom panel adjacent to the first side panel, at least one top-receiving cut pattern in the bottom panel, a second side panel adjacent to the top panel and adjacent to the bottom panel, an intermediate panel located between the top panel and the bottom panel, wherein the intermediate panel includes at least one aperture, and a plurality of containers, a first of the plurality of containers extending through one of the top receiving cut patterns in the bottom panel and through one of the apertures in the intermediate panel.

According to the first embodiment, the intermediate panel serves to stabilize the containers within the package.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWING FIGURES

DETAILED DESCRIPTION

The present embodiments are addressed to cartons for attachment to containers. A carton 100 is illustrated in its erected state in FIG. 5, in which it is attached to containers 120, forming a package 150.

Figure 1:
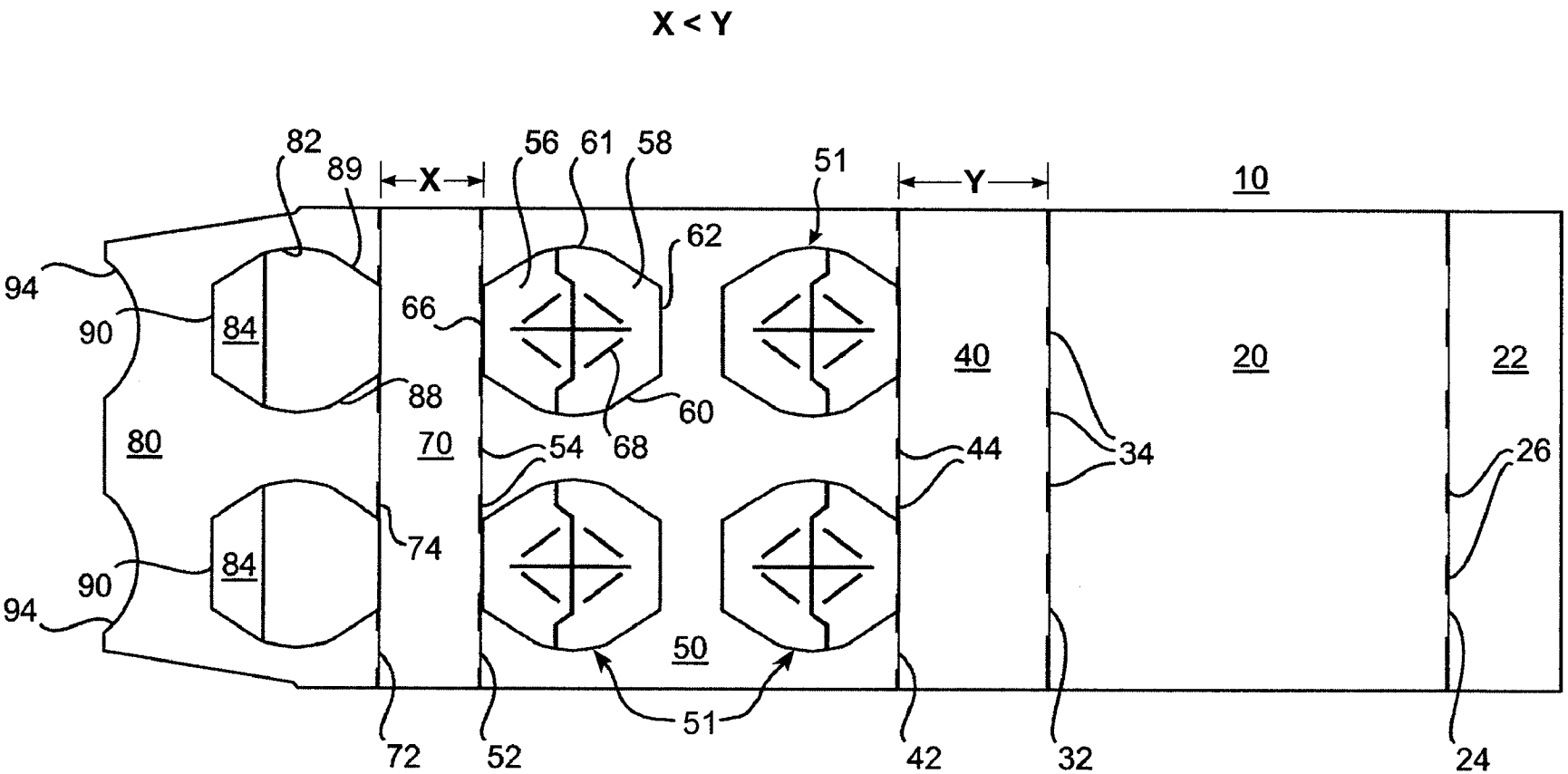
FIG. 1 is a plan view of a blank used to form a package according to a first embodiment.

FIG. 1 is a plan view of a blank 10 used to form the carton 100. The blank 10 comprises a top panel 20 foldably connected to a first side panel 40 at a first transverse fold line 32, a bottom panel 50 foldably connected to the first side panel 40 at a second transverse fold line 42, a second side panel 70 foldably connected to the bottom panel 50 at a third transverse fold line 52, and an intermediate panel 80 foldably connected to the second side panel 70 at a fourth transverse fold line 72. An adhesive flap 22 may be foldably connected to the top panel 20 at a fifth transverse fold line 24.

One or more cuts 34, 44, 54, 74, 26 may be placed along each of the transverse fold lines 32, 42, 52, 72, 24, respectively. In the embodiment illustrated in FIG. 1, the transverse fold lines 32, 42, 52, 72, 24 are cut/crease lines in which the cuts 34, 44, 54, 74, 26 facilitate folding of the blank 10 at the fold lines. Any number of cuts may be formed along the fold lines, and the number and length of the cuts may be selected according to, for example, the gauge and the stiffness of the material used to form the blank 10.

The bottom panel 50 includes a plurality of top-receiving cut patterns 51. Each top-receiving cut pattern 51 is shaped and sized to receive an upper portion of a container 120 that is to be held within the carton 100. Each pattern 51 includes first and second side cuts 60, 61, first and second fold lines 62, 66, a medial cut 65, and deformation cuts 68. The cuts define a first strut 56 and a second strut 58. The struts 56, 58 are foldably connected about the first and second fold lines 62, 66, respectively. The deformation cuts 68 that allow for deformation of the struts 56, 58 around a top portion of a container 120.

The intermediate panel 80 includes brace apertures 82 and support struts 84. The apertures 82 and struts 84 are defined by cuts 88, 89, with the support struts 84 being foldable about fold lines 90. The apertures 82 and support struts 84 are sized and shaped to stabilize a row of containers within the carton 100. Curved edges 94 of the intermediate panel 80 are shaped and sized to stabilize an adjacent row of containers 120 within the carton 100. As shown in FIG. 1, the blank 10 is generally rectangular and narrows at the intermediate panel 80.

Figure 2:
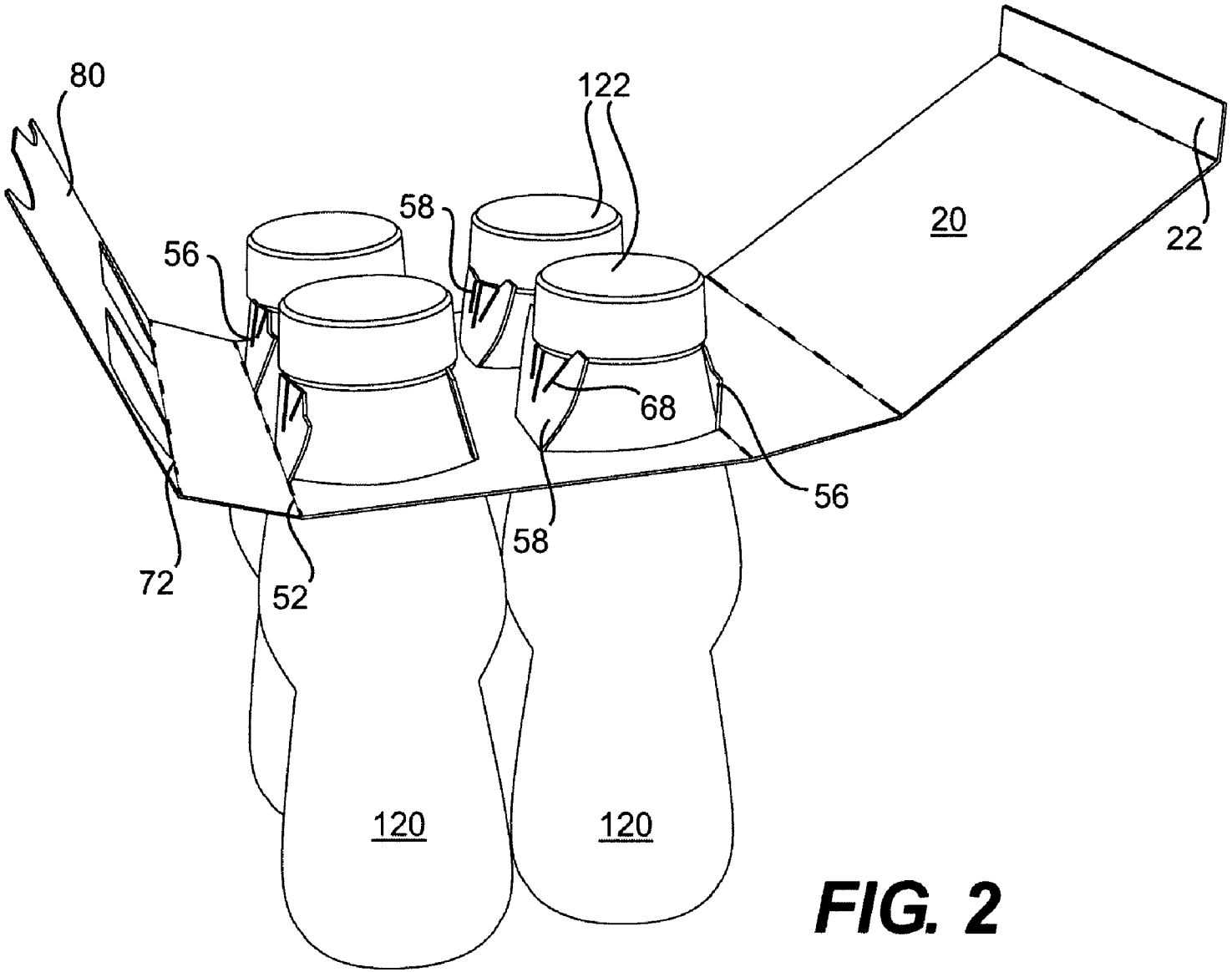
FIG. 2 is a perspective view of an erection step of a package formed from the blank of FIG. 1.

FIG. 2 is a perspective view of an erection step of the carton 100 and its attachment to the containers 120. Top portions of the containers 120 are inserted through the top-receiving cut patterns 51 so that a first strut 56 and a second strut 58 engage the underside of a radially protruding part of each container 120. The struts 56, 58 may deform at the cuts 68 so that the struts 56, 58 conform closely with the perimeters of the containers 120.

Figure 3:
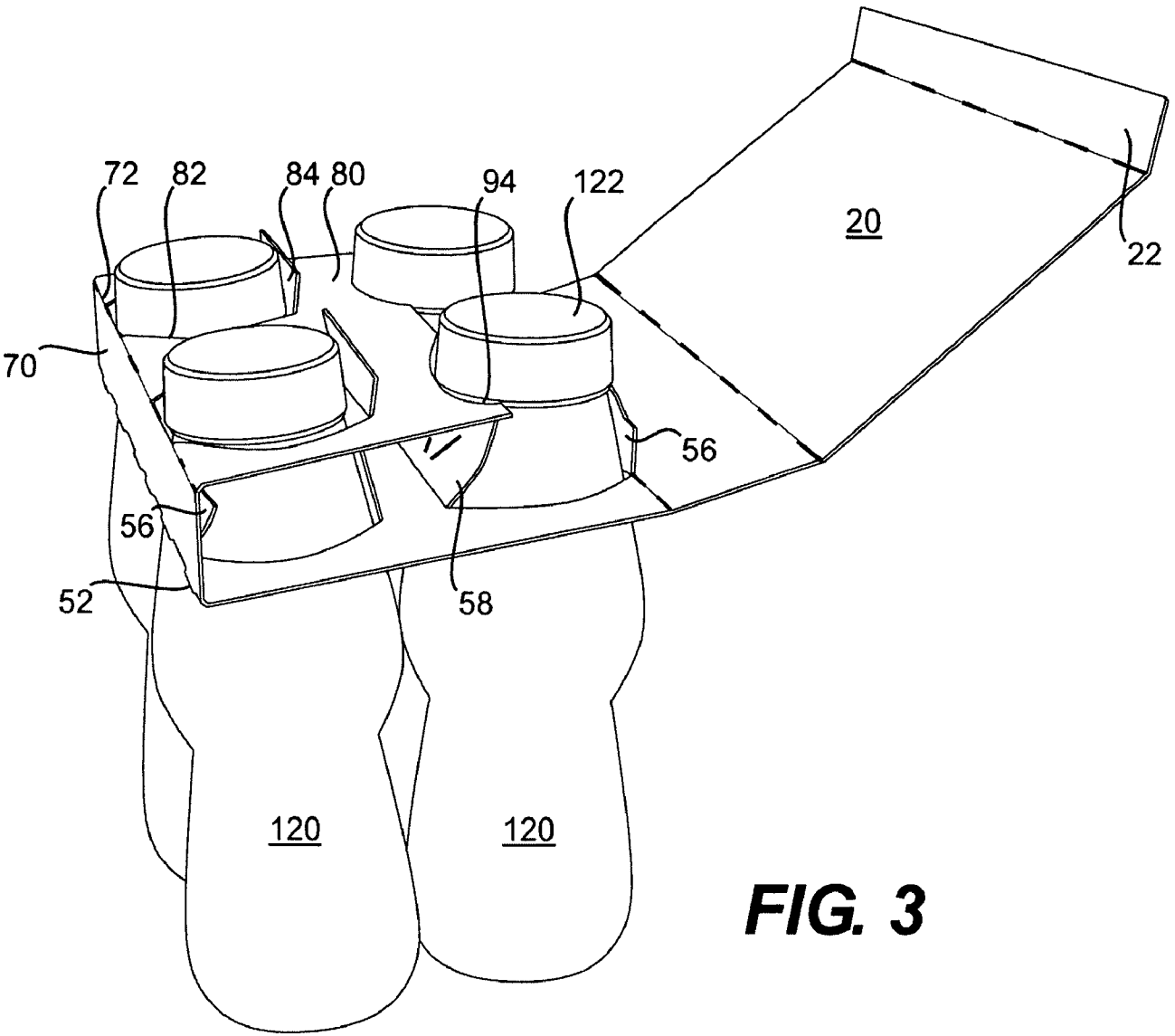
FIG. 3 is a perspective view of an erection step of the package.
Figure 4:
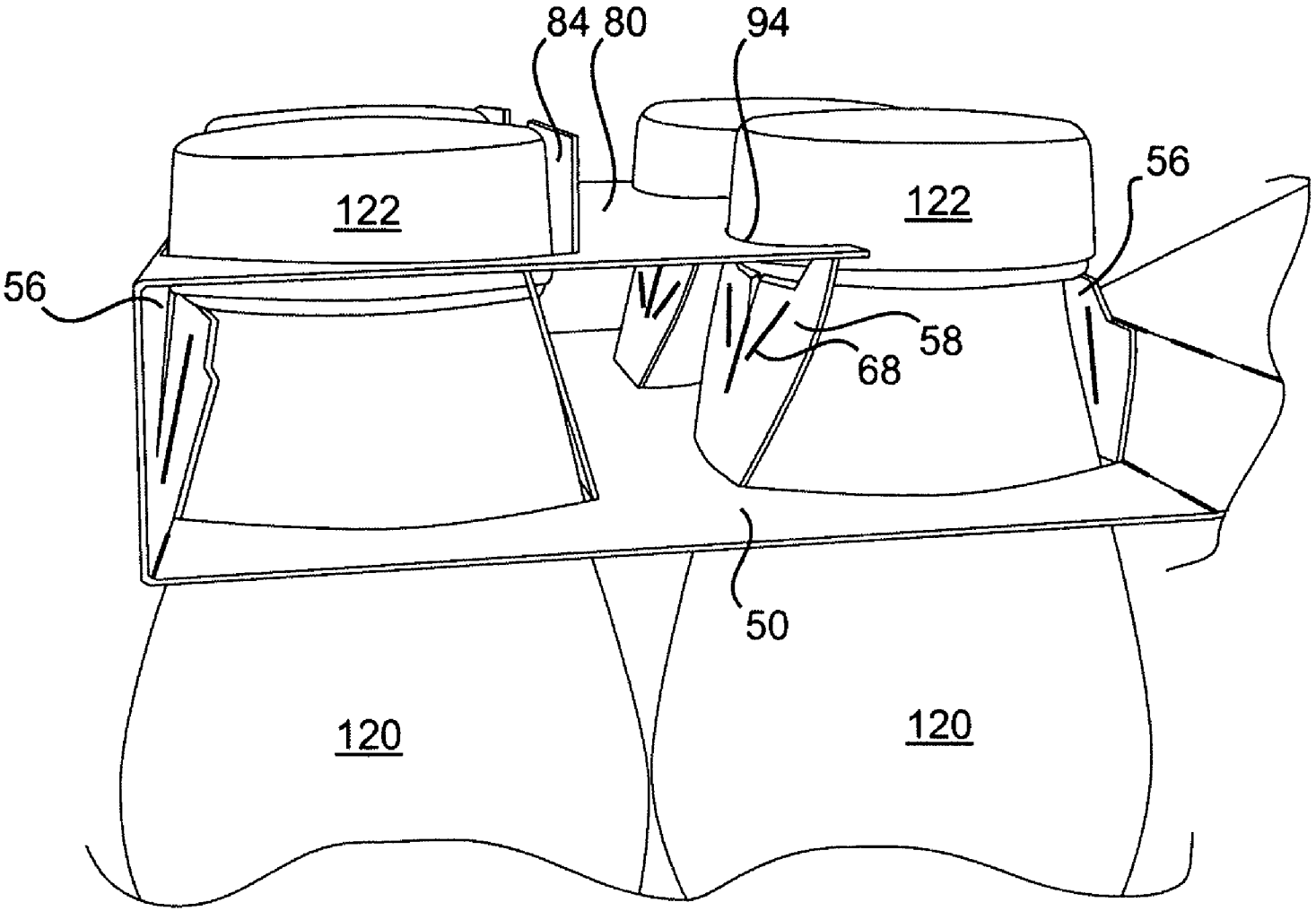
FIG. 4 is a perspective view of an erection step of the package.

FIG. 3 illustrates engagement of the intermediate panel 80 with the tops of the containers 120. The intermediate panel 80 is engaged with the containers 120 by folding the blank 10 along the fold lines 52, 72 and inserting the tops of one row of containers 120 through the apertures 82. Each container 120 in the adjacent row of containers is engaged with one of the curved edges 94 of the intermediate panel 80. FIG. 4 illustrates the engagement of the edges 94 with the containers 120 in the right side row. When the intermediate panel 80 is folded into position, the underside of the intermediate panel 80 may rest on the tops of the first and second struts 56, 58. The cuts 68 in the struts 56, 58 allow the struts to distort so that they closely conform the exterior of the containers 120. Upper edges of the struts 56, 58 may engage undersides of caps 122 or other radially protruding parts of the containers 120.

Figure 5:
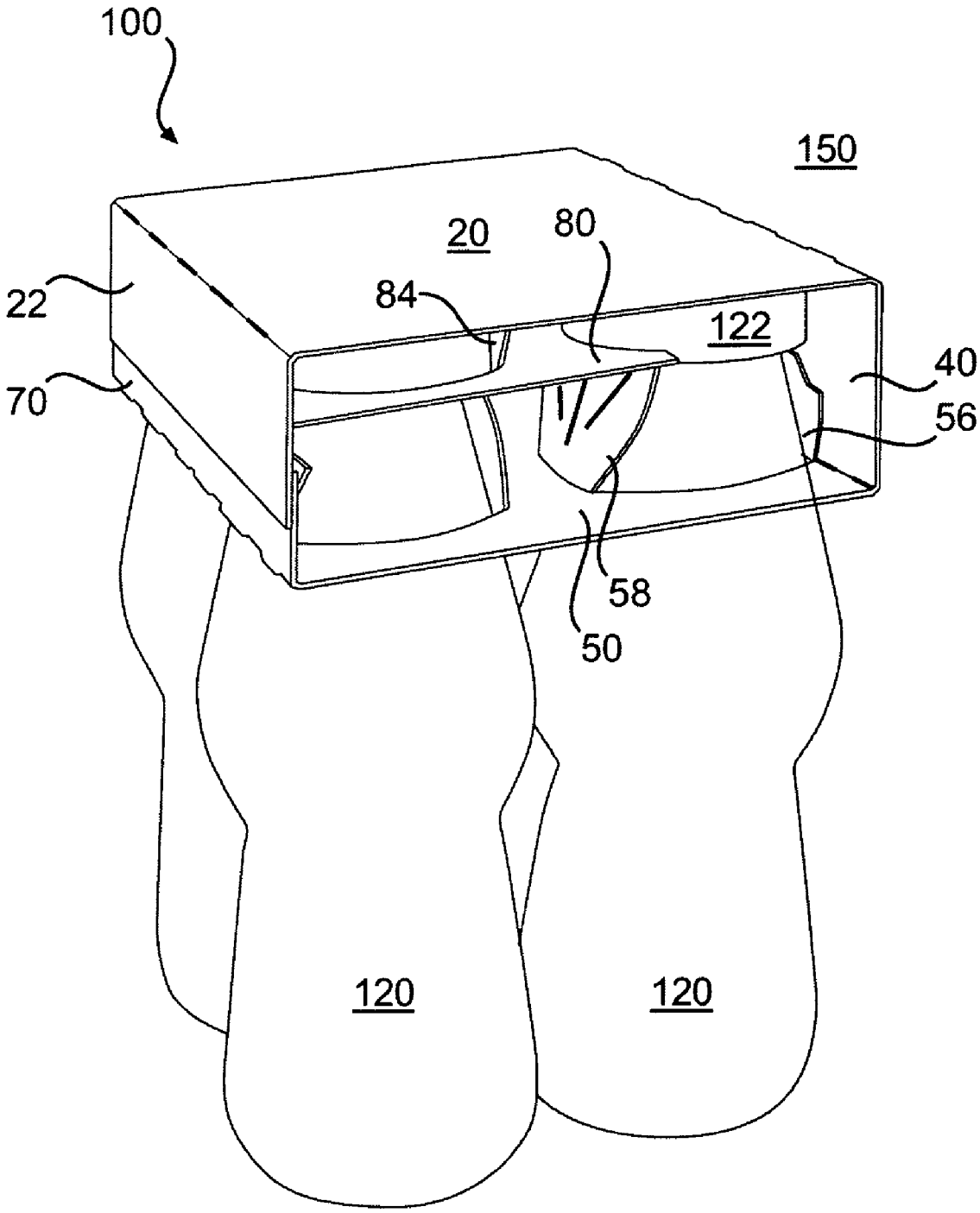
FIG. 5 is a perspective view of the package.

Next, referring to FIG. 5, the adhesive flap 22 is brought into contact with and secured to the exterior of the second side panel 70. The flap 22 can be secured using, for example, glue, glue strips, or other means. When the flap 22 is secured, the containers 120 are held securely in place by the panels 50, 80, 20 and the struts 56, 58. The carton 100 with containers 120 inserted therein forms a package 150. The support struts 84 abut the underside of the top panel 20 so that the top panel remains relatively planar.

The bottom panels in the above embodiments illustrate exemplary arrangements for receiving the top of a container within the bottom panel of a carton. Other arrangements may be provided, however, to allow a container to be inserted into the carton.

The embodiment shown in FIG. 4 illustrates a carton 100 accommodating four containers 120 in two rows and two columns. Additional columns, for example, may be added by increasing the width of the blank 10 (in the transverse direction in FIG. 1) and by adding top-receiving cut patterns 51 in the bottom panel 50 and apertures 82 in the intermediate panel 80. Ten containers, for example, could be accommodated in a 2×5 arrangement. 2×3 and 2×4 arrangements are also possible.

The blank 10 can be, for example, formed from hard paper, paperboard and similar materials. The first and second sides of the blanks can be coated with, for example, a clay coating. The clay coating may then be printed over with product, advertising, and other information or images. The blank may then be coated with a varnish to protect any information printed on the blank.

In the above embodiment, the carton 100 are shown as accommodating generally cylindrical containers 120 having a round upper rim or cap. Other types of containers, however, can be accommodated by a carton according to the present invention.

In the above embodiments, the fold lines may be formed in the blanks by any appropriate method. For example, the fold lines can be formed by creasing or scoring a part of the blanks. Other methods for forming fold lines in blanks may also be used.

The description is not intended to limit the invention to the form disclosed herein. Also, it is intended that the appended claims be construed to include alternative embodiments, not explicitly defined in the detailed description.

What is claimed is:

1. A carton blank for assembling into a carton for accommodating at least a first and a second row of containers, the blank comprising:

a top panel;

a first side panel;

a bottom panel;

at least four top-receiving cut patterns in the bottom panel arranged in at least a first and a second row and at least a first and a second column, each cut pattern being sized to receive at least one of the containers;

a second side panel;

an intermediate panel foldably connected to the second side panel, wherein the first side panel has a substantially greater width than the second side panel so that the intermediate panel is spaced apart from the top panel when the carton blank is formed into the carton, wherein the intermediate panel includes at least two apertures arranged in a first row, each aperture being sized to receive at least one of the containers in the first row of containers, wherein a distal edge of the intermediate panel is arranged to engage an upper portion of at least one of the containers in the second row of containers;

an adhesive flap foldably connected to the top panel, wherein the second side panel is foldably connected to the intermediate panel at a transverse fold line and each aperture in the intermediate panel abuts the transverse fold line, wherein the bottom panel is foldably connected to the second side panel, a distance between a foldable connection between the intermediate panel and the second side panel and a foldable connection between the bottom panel and the second side panel is less than a distance corresponding to the maximum width of the first side panel.

2. The blank according to claim 1, wherein the intermediate panel is arranged to be spaced from the top panel and spaced from the bottom panel.

3. The blank according to claim 2, wherein each top-receiving cut pattern defines a first and a second strut, each strut being foldably connected to the bottom panel.

4. The blank according to claim 2, wherein a support strut is adjacent to each aperture in the intermediate panel.

5. The blank according to claim 2, wherein the intermediate panel includes curved edges.

6. The blank according to claim 1, wherein the top panel and bottom panel are approximately the same size.

7. The carton blank of claim 1 wherein each aperture in the intermediate panel intersects the transverse fold line and divides the transverse fold line into spaced apart portions.

8. The carton blank of claim 1 wherein the first side panel is foldably connected to the bottom panel and the top panel, a distance between a foldable connection between the first side panel and the bottom panel and a foldable connection between the first side panel and the top panel corresponds to the maximum width of the first side panel.

9. A package, comprising:

a top panel;

a first side panel adjacent to the top panel;

a bottom panel adjacent to the first side panel;

at least four top-receiving cut patterns in the bottom panel arranged in at least a first and a second row and at least a first and a second column;

a second side panel adjacent to the top panel and adjacent to the bottom panel;

an intermediate panel located between the top panel and the bottom panel, wherein the intermediate panel includes at least two apertures arranged in a first row, the intermediate panel being connected to and extending from the second side panel, being spaced apart from the top panel where the intermediate panel is connected to the second side panel and located below the top panel where the intermediate panel is connected to the second side panel, and being in a parallel planar relationship with the top panel across an entire width of the intermediate panel from a foldable connection with the second side panel to a free edge of the intermediate panel; and a plurality of containers arranged in at least a first and a second row and at least a first and a second column, each container extending through a respective one of the top receiving cut patterns in the bottom panel, wherein each container in the first row of containers extends through one of the apertures in the intermediate panel, and at least one of the containers in the second row of containers is adjacent to a distal edge of the intermediate panel.

10. The package according to claim 9, wherein each top-receiving cut pattern defines a first and a second strut, each strut being foldably connected to the bottom panel and being adjacent to a top portion of one of the containers.

11. The package of claim 10, wherein each strut engages the underside of a radially protruding part of a container.

12. The package according to claim 10, further comprising a plurality of support struts, each support strut extending upright toward the top panel and being adjacent to a corresponding aperture in the intermediate panel.

13. The package according to claim 12, wherein a distal edge of the intermediate panel includes curved edges, each curved edge engaging one of the containers.

14. The package according to claim 13, wherein the distal edge of the intermediate panel abuts at least one of the second struts.

15. The package according to claim 9, wherein the intermediate panel is spaced from the bottom panel.

16. The package of claim 9 wherein the intermediate panel extends from the second side panel and is in substantially orthogonal planar relationship with the second side panel across an entire width of the intermediate panel from a foldable connection with the second side panel to a free edge of the intermediate panel.

17. A package, comprising:

a top panel;

a first side panel adjacent to the top panel;

a bottom panel adjacent to the first side panel;

a plurality of top-receiving cut patterns in the bottom panel arranged in at least a first row and a second row, wherein each top-receiving cut pattern defines at least one strut, each strut being foldably connected to the bottom panel;

a second side panel adjacent to the bottom panel;

an intermediate panel foldably connected to the second side panel and located between and spaced apart from the top panel and the bottom panel, the intermediate panel being spaced apart from the top panel across the entire width of the intermediate panel, wherein the intermediate panel includes a first row of at least one aperture; and a plurality of containers arranged in at least a first and a second row, each container extending through a respective one of the top-receiving cut patterns in the bottom panel, wherein each container in the first row of containers extends through a respective one of the apertures in the intermediate panel, an upper portion of at least one of the containers in the second row of containers abuts a distal edge of the intermediate panel, and each strut engages an underside of a radially protruding part of a container, and wherein an underside of the intermediate panel abuts an upper free edge of at least one of the first row top-receiving cut pattern struts and at least one of the second row top-receiving cut pattern struts, each strut comprises an upper distal edge and a lower distal edge, wherein the lower distal edge engages the underside of the radially protruding part of the container and the upper distal edge engages an underside of the intermediate panel.

18. The package according to claim 17, wherein the intermediate panel is connected to and extends from a top edge of the second side panel, and the intermediate panel is spaced below and free from contact with the top panel across an entire width of the intermediate panel.

19. A package, comprising:

a top panel;

a first side panel adjacent to the top panel;

a bottom panel adjacent to the first side panel;

at least four top-receiving cut patterns in the bottom panel arranged in at least a first and a second row and at least a first and a second column;

a second side panel adjacent to the top panel and adjacent to the bottom panel;

an intermediate panel located between the top panel and the bottom panel, wherein the intermediate panel includes at least two apertures arranged in a first row, the intermediate panel being connected to and extending from the second side panel, being spaced apart from the top panel where the intermediate panel is connected to the second side panel and located below the top panel where the intermediate panel is connected to the second side panel; and a plurality of containers arranged in at least a first and a second row and at least a first and a second column, each container extending through a respective one of the top receiving cut patterns in the bottom panel, wherein each container in the first row of containers extends through one of the apertures in the intermediate panel, and at least one of the containers in the second row of containers is adjacent to a distal edge of the intermediate panel, wherein each top-receiving cut pattern defines a first and a second strut, each strut being foldably connected to the bottom panel and being adjacent to a top portion of one of the containers and engaging an underside of a radially protruding part of a container each of the second struts comprising an upper distal edge and a lower distal edge, wherein the lower distal edge engages the underside of the radially protruding part of the container and the upper distal edge engages an underside of the intermediate panel.

* * * * *